US005537767A

United States Patent [19]

Schneider et al.

[11] Patent Number: 5,537,767

[45] Date of Patent: Jul. 23, 1996

[54] MODULAR DISPLAY STAND

[75] Inventors: Richard F. Schneider, Oakdale; Ronald J. Greenfield, Melville, both of N.Y.

[73] Assignee: Tri-Molded Plastics Inc., Bay Shore, N.Y.

[21] Appl. No.: 467,949

[22] Filed: Jun. 6, 1995

[51] Int. Cl.[6] ..... G09F 15/00

[52] U.S. Cl. ..... 40/606; 40/661

[58] Field of Search ..... 40/606, 610, 611, 40/661, 152, 152.1, 649; 248/176, 346, 224.3; 403/334; 24/537

[56] References Cited

U.S. PATENT DOCUMENTS

| | | | |
|---|---|---|---|
| 3,131,290 | 4/1964 | Stepoth | 403/334 X |
| 3,237,330 | 3/1966 | Distbir | 40/606 X |
| 4,144,664 | 3/1979 | De Korte | 40/152.1 |
| 4,165,572 | 8/1979 | Sussman | 40/152.1 |
| 4,171,583 | 10/1979 | Korsemann | 40/152 |
| 4,242,817 | 1/1981 | Ballard | 40/152.1 |
| 4,594,802 | 6/1986 | Field | 40/661 |
| 4,726,132 | 2/1988 | Ernest | 40/606 |
| 4,790,093 | 12/1988 | Ernest et al. | 40/606 |
| 5,058,300 | 10/1991 | Ernest et al. | 40/606 |
| 5,195,263 | 3/1993 | Huang | 40/152 |
| 5,331,757 | 7/1994 | Ernest et al. | 40/600 |
| 5,388,359 | 2/1995 | DeWitt | 40/606 |
| 5,390,437 | 2/1995 | Pearson | 40/661 |

FOREIGN PATENT DOCUMENTS

| | | | |
|---|---|---|---|
| 30200 | 3/1977 | Japan | 40/661 |
| 9011590 | 10/1990 | WIPO | 40/604 |

*Primary Examiner*—Kenneth J. Dorner
*Assistant Examiner*—Cassandra Davis
*Attorney, Agent, or Firm*—Dilworth & Barrese

[57] ABSTRACT

A modular display stand is disclosed which includes first and second display panels each including a substantially planar display portion and a mounting flange which depends from the display portion at an acute angle. Each mounting flange includes a reception port and an engagement plug disposed in spaced apart relationship. A base structure is provided which has an elongate reception slot defined therein to receive and retain the mounting flanges of the opposed display panel when they are in juxtaposition. When the flanges are received in the slot, the engagement plug on the first display panel engages the reception port in the second display panel and the engagement plug on the second display panel engages the reception port in the first panel. In an assembled condition, the mounting flanges are disposed in inward angular opposition such that the planar display portions of the panels angle inwardly toward one another to firmly retain printed matter therebetween.

19 Claims, 5 Drawing Sheets

FIG. 3
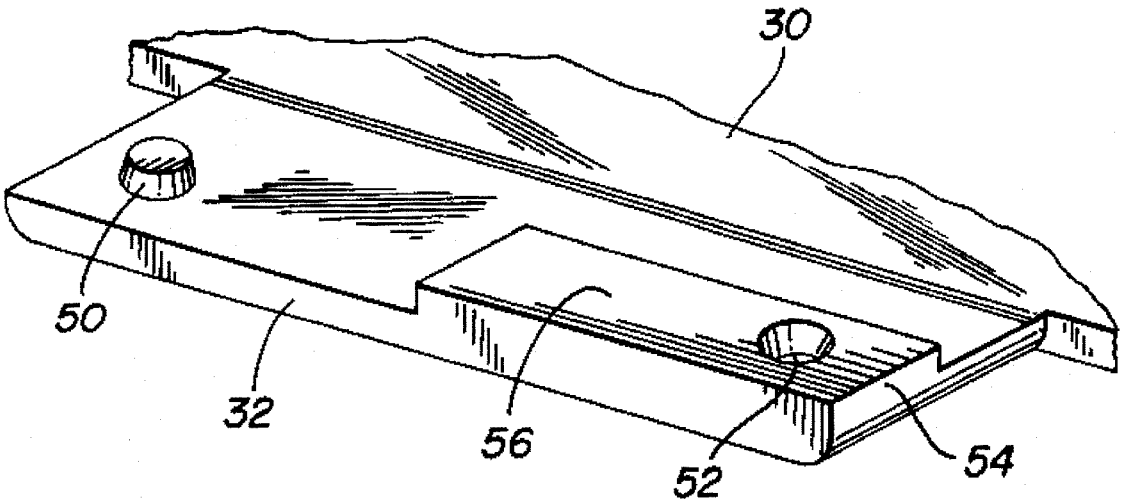
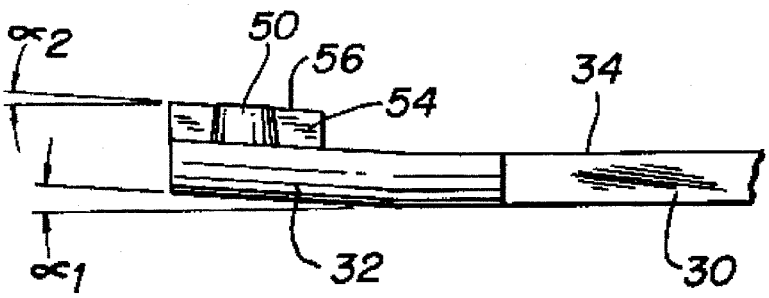
FIG. 4

MODULAR DISPLAY STAND

BACKGROUND OF THE INVENTION

1. Technical Field

The subject invention relates to display devices, and more particularly, to a modular display stand for displaying printed matter on a table top, or the like.

2. Description of the Related Art

Table top display stands are well known in the art as a means for displaying advertisements, menus, wine lists and other informational literature. Conventional display stands are formed by cutting a flat plastic blank from sheet stock, applying heat to the blank at desired locations, and then bending the blank to create two opposed upstanding display panels and an integral base section. Printed literature is then displayed between the two upstanding display panels.

An example of a prior art display stand is disclosed in U.S. Pat. No. 4,165,572 to Sussman. It is constructed from two complementary members each formed by an upright panel having a right-angled ledge depending from the bottom edge thereof. The two ledges extend in opposite directions to form a base when the two panels are brought together to support a display sheet therebetween. Each panel is provided with interlocking tongue and groove structures which serve to maintain the two members in juxtaposition once assembled.

Another prior art display stand is disclosed in U.S. Pat. No. 5,390,437 to Pearson. It includes two injection molded panels and a base section. Each panel has a transparent vertical display portion and a sloping lower surface portion which engages a complementary surface within the base section when the two panels are aligned and inserted through a slot in the base section. Once assembled, the two panels are held within the base section by integral retaining ribs formed on the two panels.

Other prior art display devices are disclosed in U.S. Pat. Nos. 4,726,132; 4,790,093; 5,058,300; and 5,331,757. Each of these prior art devices includes two transparent plastic display panels which are supported on a stand having a generally U-shaped bracket with inclined bearing walls that are biased against the lower edges of the display panels to maintain then in juxtaposed alignment.

The subject invention provides a modular table top display stand which may be manufactured, assembled, and utilized with greater ease than prior art display stands.

SUMMARY OF THE INVENTION

The subject invention is directed to a modular display stand for displaying printed matter such as advertisements, menus or wine lists, on a table, bar or counter top. The display stand includes first and second opposed display panels which are preferably formed from a transparent thermoplastic material. Each display panel has a substantially planar display portion and a mounting flange which depends from the display portion at an acute angle.

The display stand further includes a base structure having an elongate reception slot defined therein. The reception slot is dimensioned and configured to receive and retain the mounting flanges of the two display panels when they are in juxtaposition. When received in the slot, the mounting flanges mirror one another in inward angular opposition such that the planar display portions of the two panels deflect inwardly with respect to one another to firmly retain printed matter therebetween.

Preferably, the mounting flange on each of the display panels includes a reception port and an engagement plug disposed in spaced apart relationship. In use, when the two display panels are brought into juxtaposition, the engagement plug on the first display panel engages the reception port in the second display panel, and the engagement plug on the second display panel engages the reception port in the first panel.

The mounting flange on each display panel preferably depends from the display portion at an acute angle of about between 3° and 5°, and each has an elevated step formed thereon within which the reception port is defined. The elevated step has an inclined mating surface which corresponds to the angle at which the mounting flange depends from the display portion so that when the two mounting flanges are brought into juxtaposition, they are in close cooperative alignment with one another.

These and other features of the display stand of the subject invention will become more readily apparent to those skilled in the art from the following detailed description of the preferred embodiments of the invention taken in conjunction with the drawings.

BRIEF DESCRIPTION OF THE DRAWINGS

So that one skilled in the art to which the subject invention appertains will better understand how to make and use the modular display stand disclosed herein, preferred embodiments thereof will be described hereinbelow with reference to the drawings wherein:

FIG. 3 is an enlarged perspective of the mounting flange provided on each of the panels of the display stand illustrated in FIG. 1;

FIG. 4 is a side elevational view of the mounting flange illustrated in FIG. 3;

DETAILED DESCRIPTION OF THE PREFERRED EMBODIMENTS

Figure 1:
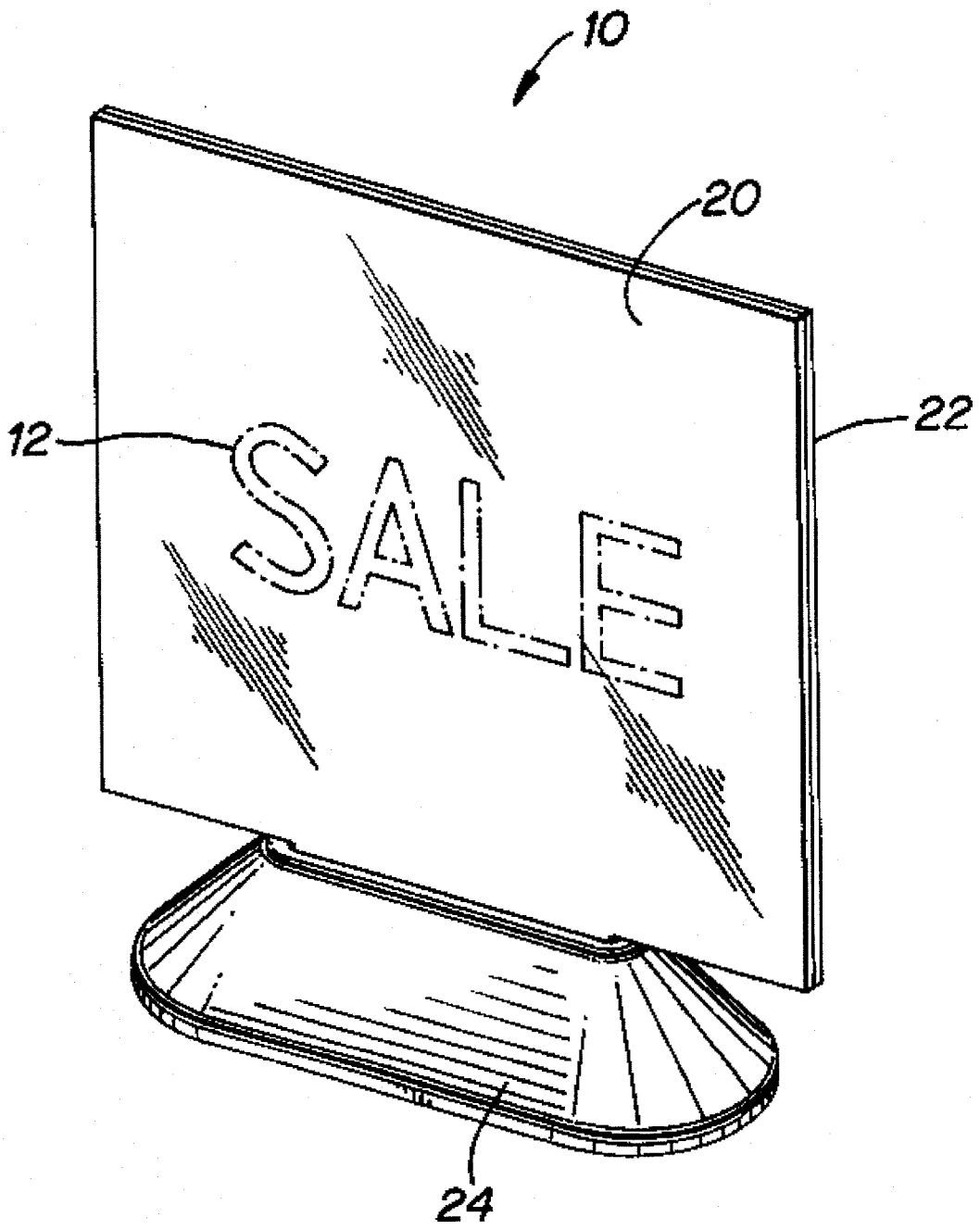
FIG. 1 is a perspective view of a modular display stand constructed in accordance with a preferred embodiment of the subject invention and illustrated with a display card having printed matter contained thereon.

Referring now to the drawings where like reference numerals identify similar structural elements of the subject invention, there is illustrated in FIG. 1 a modular display stand constructed in accordance with a preferred embodiment of the subject invention and designated generally by reference numeral 10. Display stand 10 is configured to support a card 12 containing printed matter for public viewing upon a table or counter top. The printed matter may be in the form of a menu, wine list, advertisement or schedule of events.

Referring to FIG. 1, display stand 10 is constructed of two upstanding panels 20 and 22 and a base section 24. In the illustrated assembled condition, card 12 is firmly supported between the opposed interior surfaces of panels 20 and 22. Panels 20 and 22 are preferably fabricated from a light weight, transparent thermoplastic material which is formed during an injection molding process. Base section 24 is also injection molded from a thermoplastic material which may be opaque, translucent or transparent depending upon the intended use of the display stand.

Figure 2:
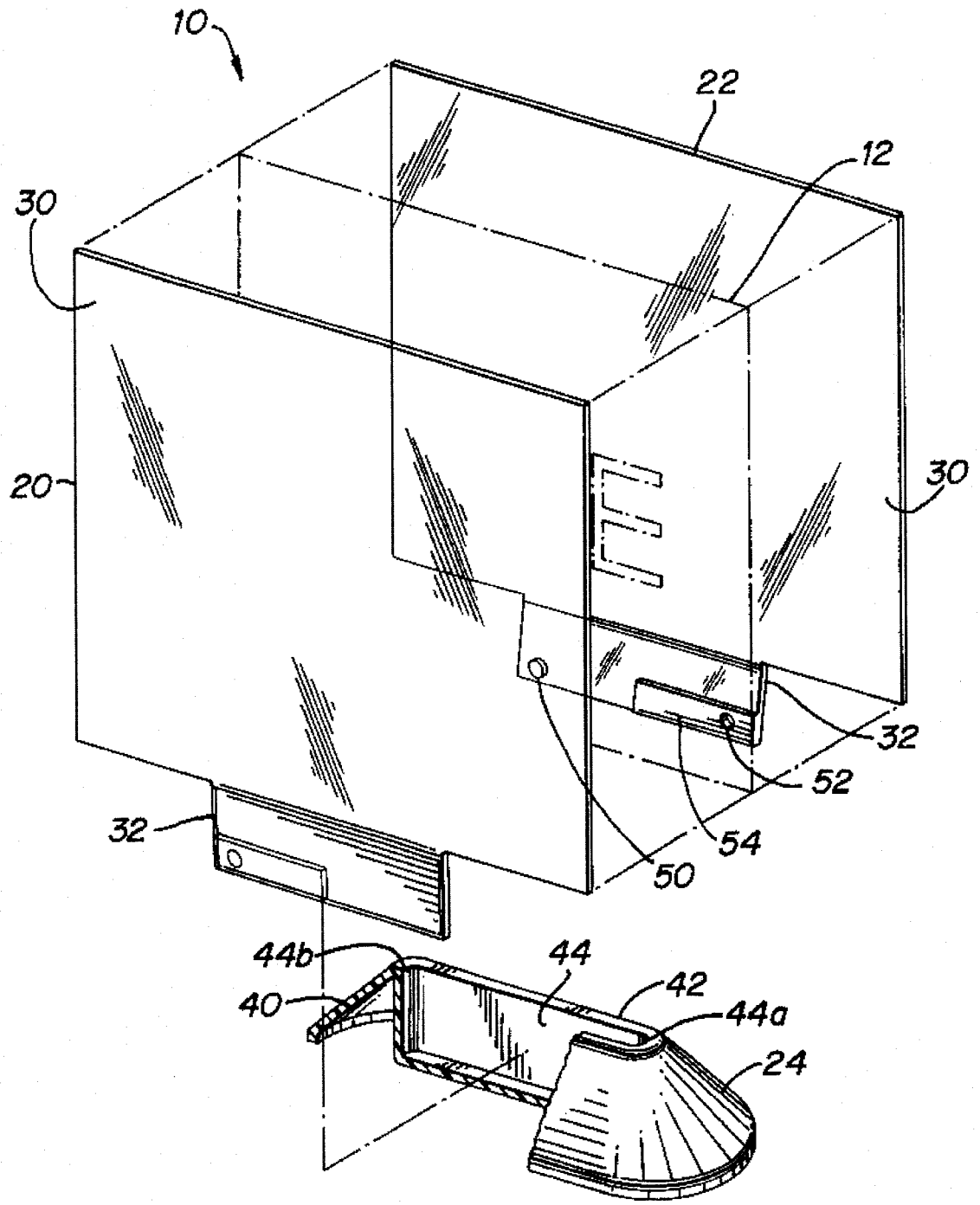
FIG. 2 is an exploded perspective view of the display stand of FIG. 1 with each of the parts thereof separated for ease of illustration and with the base portion of the display stand cross-sectioned to show the internal construction thereof.

Referring to FIG. 2, panels 20 and 22 are constructed to be mirror images of one another when display stand 10 is in an assembled condition. Each panel includes a substantially planar display portion 30 and a mounting flange 32 which depends from the plane of the interior surface 34 of the display portion at an acute angle "$\alpha_1$" of between 3° and 5°, as best seen in FIG. 4.

Figure 6:
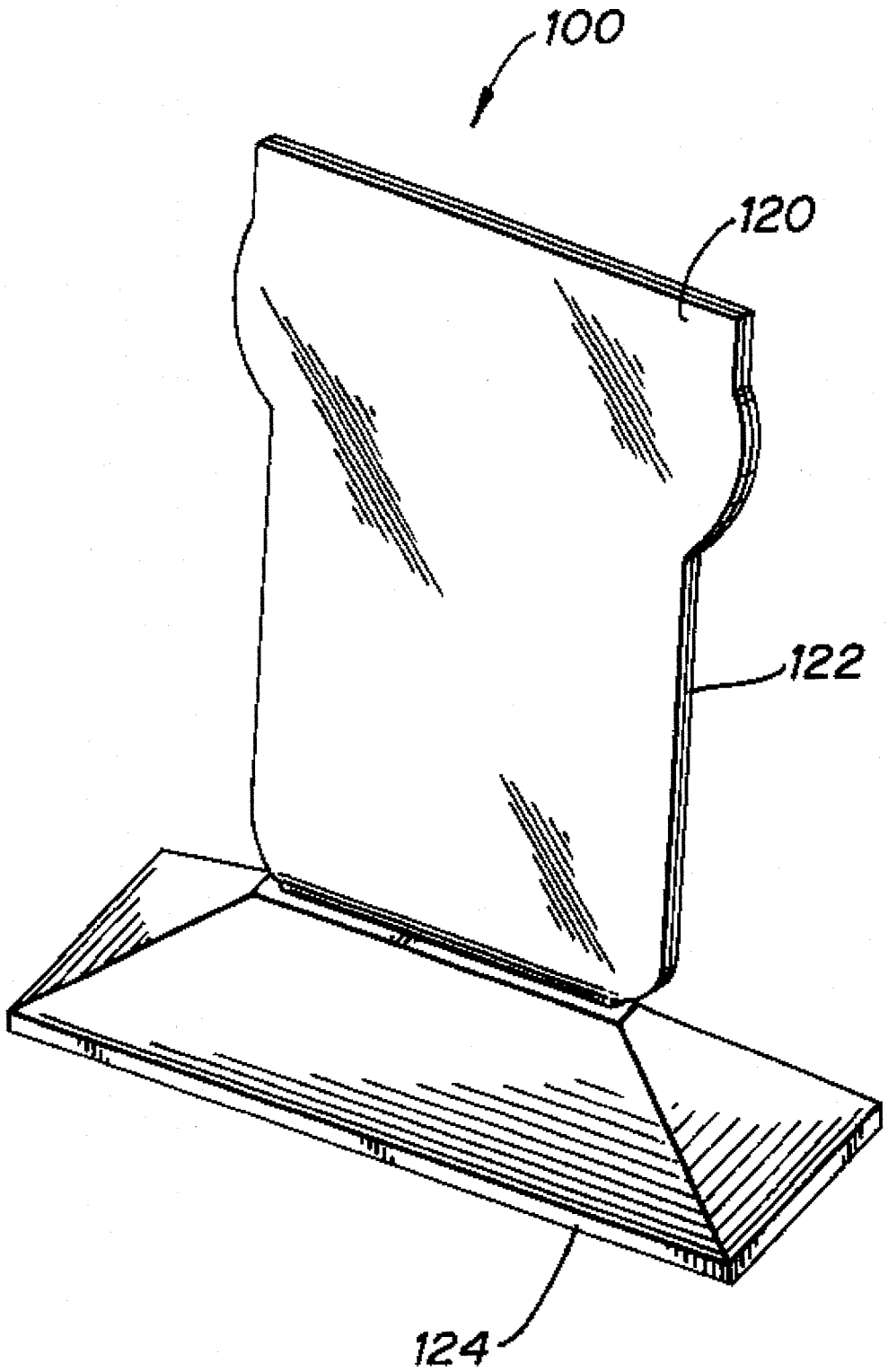
FIG. 6 is a perspective view of another embodiment of the modular display stand of the subject invention.

The display portion 30 of each panel can have a variety of different geometric configurations. For example, the display portion may have a rectangular configuration as illustrated in FIG. 1, or it can have the shape of a particular product as illustrated in FIG. 6, where display stand 100 includes panels 120 and 122 in the shape of a well known beverage glass. Alternatively, the display portion of each panel can be configured as a silhouette of a notable person, animal or object, such as a piece of sporting equipment. In any instance however, the configuration of the mounting flange 32 on each panel will remain constant in size and shape. Thus, the display stand of the subject invention may be marketed and sold as a modular kit which would include at least one base section and a plurality of different interchangeable display panels of varied geometric configuration.

As best seen in FIG. 2, base section 24 has a substantially oval periphery with a continuous radially inwardly inclined wall 40 which is truncated along an upper edge thereof to define a ledge area 42. An elongate reception slot 44 is defined in base section 24 extending downward into the base section from the ledge area. Slot 44 is dimensioned and configured to receive and retain the mounting flange 32 of both display panels. The lateral extremities 44*a* and 44*b* of slot 44 are radiused to accommodate the radiused edges of the mounting flanges. When the display stand of the subject invention is sold as a modular kit with a plurality of interchangeable display panels, the dimensions of the mounting flanges on each display panel in the kit will be identical such that all of the panels can be utilized with the same base structure. The kit can include more than one type of base structure (See, for example, base structure 124 in FIG. 6), although the reception slot 44 in each structure would be identical in dimension and configuration.

Referring now to FIG. 3, the mounting flange 32 on each panel of display stand 10 includes interlocking structures which maintain panels 20 and 22 in juxtaposition within base section 24. The interlocking structures include an engagement plug 50 and a reception port 52 which are disposed in spaced apart relationship. Reception port 52 is defined within an elevated step 54 of rectangular configuration that extends approximately half the width of mounting flange 32. As best seen in FIG. 4, step 54 has an inclined mating surface 56 which has an angle of inclination "$\alpha_2$" that is approximately equal to the angle at which mounting flange 32 depends from display portion 30.

Preferably, as illustrated in FIG. 3, engagement plug 50 and reception port 52 both have tapered peripheries which complement and accommodate each other when the mounting flanges of display panels 20 and 22 are brought into juxtaposition. In addition, when the two mounting flanges are juxtaposed, the angular mating surfaces 56 cooperatively align with the corresponding angular surfaces of the mounting flanges to form a closely nested interlocked structure.

Figure 5:
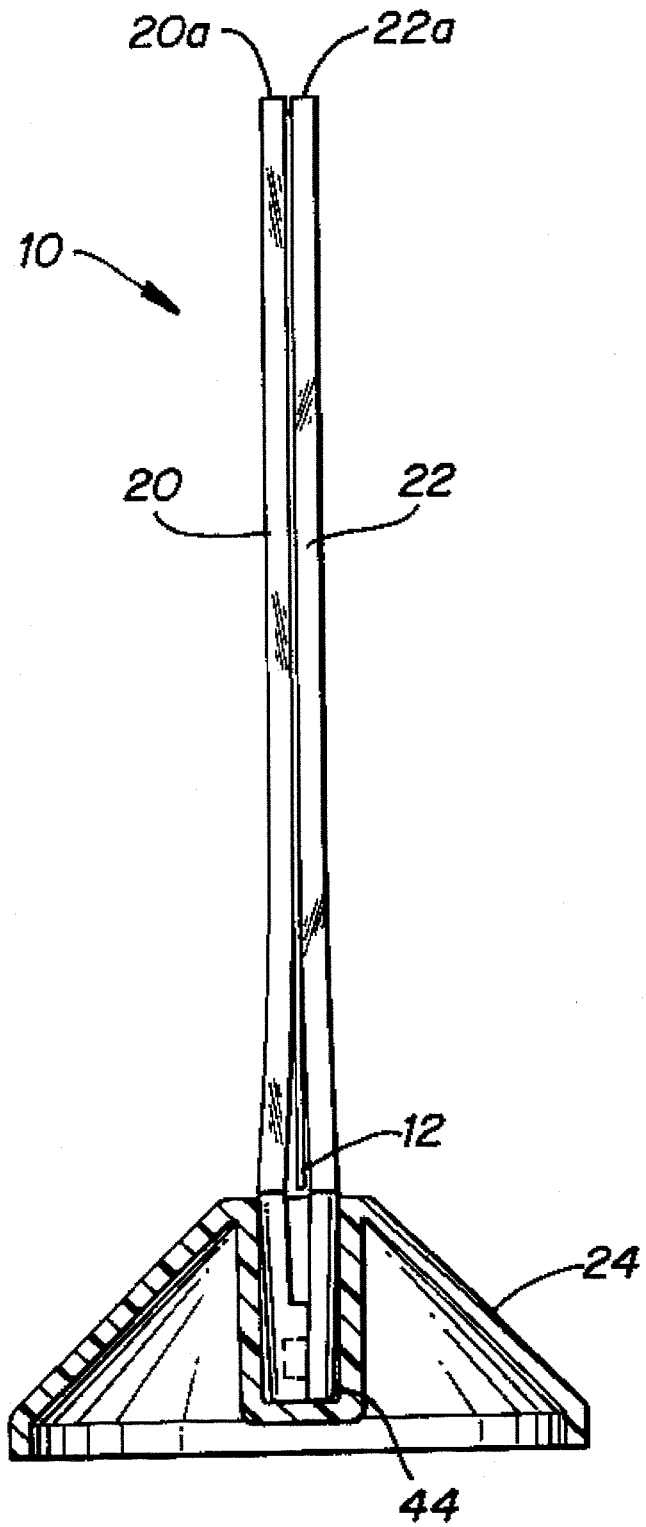
FIG. 5 is a side elevational view of the display stand of FIG. 1 in an assembled condition illustrating the inward inclination of the two display panels.

During assembly, when the juxtaposed mounting flanges of both panels are inserted into reception slot 44, the angular orientation of the mounting flanges cause the display portions of each display panel to angle inwardly toward one another, as shown in FIG. 5 and indicated by the directional arrows provided therein. Accordingly, the respective upper edges 20*a* and 22*a* of display panels 20 and 22 are brought into close cooperative alignment with one another, firmly holding card 12 between the interior surfaces thereof where it may be easily viewed by the public.

Although the display stand of subject invention has been described with respect to a preferred embodiment, it will be readily apparent to those having ordinary skill in the art to which the subject invention appertains that changes and modifications may be made thereto without deporting from the spirit or scope of the invention as defined by the appended claims.

What is claimed is:

1. A display stand which comprises:

first and second opposed display panels each including a substantially planar display portion having an interior surface for displaying printed matter therebetween and opposed upper and lower edges, each display panel having a mounting flange depending downwardly from the lower edge thereof at an acute angle with respect to the display portion thereof; and a base structure having an elongate reception slot defined therein, said reception slot being dimensioned and configured to receive and retain the mounting flanges of said opposed display panels with said mounting flanges disposed in inward angular opposition such that the upper edges of the planar display portions of said panels angle inwardly toward one another to firmly retain the printed matter between the opposed interior surfaces thereof.

2. A display stand as recited in claim 1, wherein the mounting flange on each of said display panels includes a reception port and an engagement plug disposed in spaced relationship such that the engagement plug on said first display panel engages the reception port in said second display panel and the engagement plug on said second display panel engages the reception port in said first panel when the mounting flanges are juxtaposed and retained in the reception slot of said base structure.

3. A display stand as recited in claim 2, wherein the reception port in each mounting flange is tapered radially inwardly, and the engagement plug on each mounting flange has a complementary tapered configuration.

4. A display stand as recited in claim 1, wherein the mounting flange on each display panel depends from the display portion thereof at an acute angle of between 3° and 5°.

5. A display stand as recited in claim 2, wherein each mounting flange has an elevated step formed thereon within which said reception port is defined.

6. A display stand as recited in claim 5, wherein the elevated step formed on each mounting flange has an inclined surface which corresponds to the angle at which the mounting flange depends from the display portion of the display panel.

7. A display stand as recited in claim 1, wherein at least the display portion of each of said display panels is formed of a transparent material.

8. A display stand as recited in claim 1, wherein the elongate reception slot has radiused lateral extremities and each mounting flange has opposed lateral edges which are radiused to complement the reception slot.

9. A display stand as recited in claim 1, wherein said base structure has an inwardly inclined outer wall.

10. A display stand which comprises:

first and second opposed display panels each including a substantially planar display portion having an interior surface for displaying printed matter therebetween and opposed upper and lower edges, each display panel having a mounting flange depending downwardly from the lower edge thereof which includes a reception port and an engagement plug disposed in spaced relationship; and a base structure having an elongate reception slot defined therein, said reception slot being dimensioned and configured to receive and retain the mounting flanges of said opposed display panels with the engagement plug on said first display panel engaged in the reception port in said second display panel and the engagement plug on said second display panel engaged in the reception port in said first panel; and wherein the mounting flange on each display panel depends from the display portion thereof at an acute angle with respect to the display portion, the mounting flanges being in inward angular opposition with one another when retained in said reception slot such that the upper edges of the planar display portions of said panels angle inwardly towards one another to firmly retain the printed matter between the opposed interior surfaces thereof.

11. A display stand as recited in claim 10, wherein the mounting flange on each display panel depends from the display portion thereof at an acute angle of between 3° and 5°.

12. A display stand as recited in claim 10, wherein each mounting flange has an elevated step formed thereon within which said reception port is defined.

13. A display stand as recited in claim 12, wherein the elevated step formed on each mounting flange has an inclined surface which corresponds to the angle at which the mounting flange depends from the display portion of the display panel.

14. A display stand as recited in claim 10, wherein the reception port in each mounting flange is tapered radially inwardly, and the engagement plug on each mounting flange has a complementary tapered configuration.

15. A display stand as recited in claim 10, wherein the elongate reception slot in said base structure has radiused lateral extremities and each mounting flange has opposed lateral edges which are radiused to complement the reception slot.

16. A display stand which comprises:

first and second opposed display panels each including a substantially planar display portion having an interior surface for displaying printed matter therebetween and opposed upper and lower edges, each display panel having a mounting flange depending downwardly from the lower edge thereof at an acute angle with respect to the display portion thereof, each mounting flange including a reception port and an engagement plug disposed in spaced relationship; and a base structure having an elongate reception slot defined therein, said reception slot being dimensioned and configured to receive and retain the mounting flanges of said opposed display panels with the engagement plug on said first, display panel engaging the reception port in said second display panel and the engagement plug on said second display panel engaging the reception port in said first panel, and with said mounting flanges disposed in inward angular opposition such that the upper edges of the planar display portions of said panels angle inwardly toward one another to firmly retain the printed matter between the opposed interior surfaces thereof.

17. A display stand as recited in claim 16, wherein each mounting flange has an elevated step formed thereon within which said reception port is defined.

18. A display stand as recited in claim 17, wherein the mounting flange on each display panel depends from the display portion thereof at an acute angle of between 3° and 5°, and the elevated step formed on each mounting flange has an inclined surface which corresponds to the angle at which the mounting flange depends from the display portion of the display panel.

19. A display stand as recited in claim 17, wherein the reception port in each mounting flange is tapered radially inwardly, and the engagement plug on each mounting flange has a complementary tapered configuration.

* * * * *